US009470081B2

(12) United States Patent
Henriksson

(10) Patent No.: US 9,470,081 B2
(45) Date of Patent: Oct. 18, 2016

(54) METHOD AND DEVICE FOR MONITORING DOWN-THE-HOLE PERCUSSION DRILLING

(75) Inventor: Ivo Henriksson, Grangärde (SE)

(73) Assignee: SPC TECHNOLOGY AB, Stockholm (SE)

( * ) Notice: Subject to any disclaimer, the term of this patent is extended or adjusted under 35 U.S.C. 154(b) by 678 days.

(21) Appl. No.: 13/825,090

(22) PCT Filed: Sep. 19, 2011

(86) PCT No.: PCT/SE2011/051121

§ 371 (c)(1),
(2), (4) Date: Mar. 19, 2013

(87) PCT Pub. No.: WO2012/039666

PCT Pub. Date: Mar. 29, 2012

(65) Prior Publication Data

US 2013/0175091 A1 Jul. 11, 2013

(30) Foreign Application Priority Data

Sep. 20, 2010 (SE) ..... 1000943

(51) Int. Cl.
*E21B 44/00* (2006.01)

(52) U.S. Cl.
CPC ..... *E21B 44/00* (2013.01)

(58) Field of Classification Search
CPC ..... E21B 44/00; E21B 44/08; E21B 1/00; E21B 6/00; E21B 4/14; B25D 9/26
USPC ..... 175/40, 50; 173/2, 112; 367/32, 82
See application file for complete search history.

(56) References Cited

U.S. PATENT DOCUMENTS

| | | | | |
|---|---|---|---|---|
| 3,520,375 | A * | 7/1970 | Raynal et al. | 340/853.6 |
| 4,491,186 | A * | 1/1985 | Alder | 175/26 |
| 4,671,366 | A * | 6/1987 | Uitto et al. | 175/27 |
| 4,715,451 | A | 12/1987 | Bseisu et al. | |
| 4,928,521 | A | 5/1990 | Jardine | |
| 5,130,951 | A | 7/1992 | Kingman | |
| 5,151,882 | A | 9/1992 | Kingman | |

(Continued)

FOREIGN PATENT DOCUMENTS

| | | | |
|---|---|---|---|
| CN | 85104307 | A | 12/1986 |
| CN | 1089684 | A | 7/1994 |

(Continued)

OTHER PUBLICATIONS

PCT/SA/210—International Search Report—Jan. 5, 2012 (Issued in PCT/SE2011/051121).

(Continued)

*Primary Examiner* — Michael Wills, III
(74) *Attorney, Agent, or Firm* — Venable LLP; Eric J. Franklin

(57) ABSTRACT

A method and device for monitoring down-the-hole percussion drilling. A down-the-hole hammer is supplied with percussion and flushing fluid flow. The down-the-hole hammer is subjected to rotational force and to feed force. Percussion frequency or a related frequency of the down-the-hole hammer is sensed. A representation of a spread thereof is created so as to produce a response to an adjustment of at least one drilling parameter as a change of width of the spread.

22 Claims, 5 Drawing Sheets

(56) References Cited

U.S. PATENT DOCUMENTS

| | | | | |
|---|---|---|---|---|
| 5,245,811 | A | 9/1993 | Knorr | |
| 5,303,203 | A | 4/1994 | Kingman | |
| 5,321,981 | A | 6/1994 | MacPherson | |
| 5,400,299 | A | 3/1995 | Trantham | |
| 5,458,207 | A * | 10/1995 | Mattero | 175/27 |
| 5,774,418 | A | 6/1998 | Magendie et al. | |
| 6,712,160 | B1 | 3/2004 | Schultz et al. | |
| 7,051,525 | B2 * | 5/2006 | Keskiniva et al. | 60/446 |
| 7,717,190 | B2 | 5/2010 | Keskiniva et al. | |
| 2007/0107919 | A1 | 5/2007 | Strasser et al. | |
| 2010/0101310 | A1 | 4/2010 | Perie | |
| 2011/0141852 | A1 * | 6/2011 | Camwell et al. | 367/82 |

FOREIGN PATENT DOCUMENTS

| | | | |
|---|---|---|---|
| CN | 1283735 | | 2/2001 |
| CN | 1571878 | A | 1/2005 |
| GB | 2160320 | A | 12/1985 |
| GB | 2273984 | A | 7/1994 |
| JP | 4204021 | | 7/1992 |
| RU | 2390404 | C2 | 8/2008 |
| SE | 532702 | C2 | 3/2010 |
| WO | WO-03/033873 | A1 | 4/2003 |
| WO | WO-2009/002306 | A1 | 12/2008 |
| WO | WO-2009/139705 | A | 9/2009 |

OTHER PUBLICATIONS

PCT/ISA/237—Written Opinion of the International Searching Authority—Jan. 5, 2012 (Issued in PCT/SE2011/051121).

Russian Patent Office—Decision on Grant—Aug. 3, 2015 (Issued in Counterpart Application No. RU 2013118012).

* cited by examiner

METHOD AND DEVICE FOR MONITORING DOWN-THE-HOLE PERCUSSION DRILLING

CROSS-REFERENCE TO RELATED APPLICATIONS

The application claims priority to Swedish patent application 1000943-9 filed 20 Sep. 2010 and is the national phase under 35 U.S.C. §371 of PCT/SE2011/051121 filed 19 Sep. 2011.

This invention concerns a method for monitoring down-the-hole percussion drilling. The invention also concerns a device for monitoring down-the-hole percussion drilling.

BACKGROUND OF THE INVENTION

Control of down-the-hole percussion drilling in the direction of optimizing the drilling process is today to a high degree entrusted to the operator. A skilled and experienced operator achieves over a time a feeling for the drilling process and is within limits capable of relatively good results when it comes to having a drilling rig perform well according to the circumstances. For that reason, a more skilled and experienced operator achieves normally better overall results when it comes to efficiency and total economy compared to a non-experienced operator.

Even the skilled and experienced operator can, however, not continuously over time regulate a drilling rig for best performance, in particular when the drill bit passes rock formations with different properties and during the varying conditions that prevail simply because of hole length and hole depth.

Also in respect of skilled and experienced operators, it can not be expected that all parameters associated with drilling can be adjusted for best performance during the drilling process.

When it comes to not so skilled and experienced operators, the same feel for the drilling process is likely not to have been achieved and the result is likely to be less efficient and in worse case damaging to the equipment including but not limited to the drill bit.

In order to monitor the drilling process, the operator may have access to drilling rate values, whereby drilled distance per time unit can be monitored. Further, the operator normally has access to parameter figures for fluid pressures, fluid flow rates and drill string rotator rotation rate. In order not to damage the drill bit or other pieces of the equipment during drilling, such parameters as i.a. feed force/weight on bit and hammer fluid pressure are subjected to limitations.

AIM AND MOST IMPORTANT FEATURES OF THE INVENTION

It is an aim of the present invention to provide a method for monitoring down-the-hole percussion drilling as indicated initially which addresses the above problems of the background art and which gives the possibility to provide drilling optimizing possibilities.

This aim is obtained when a control frequency or frequencies being representative of the percussion frequency of the down-the-hole hammer is sensed or estimated by a sensor unit possibly including a calculating unit, and a representation of a spread of said control frequency or frequencies is created so as to produce a response to an adjustment of at least one drilling parameter as a change of width of said spread.

The control frequency or frequencies can indeed be the very percussion frequency of the hammer, which is known as the base frequency, and this is preferred. It can however also be a second harmonic or further harmonic thereof or possibly some other frequency being related to the percussion frequency.

In this description, "first harmonic" means base frequency, "second harmonic" means first overtone, "third harmonic" means second overtone etc. The term "harmonics" thus include the base frequency and overtones.

In this description also, "percussion frequency spread" means basically the width of spread of the slightly different percussion frequencies (or percussion frequency distribution) that strikes delivered by the hammer are performed with as seen over a desired or determined time period. The corresponding is valid for "control frequency spread", see below.

Looking at a percussion frequency distribution with the actual performed strikes over a certain time period, this can normally be seen as a more or less broad band of frequencies around a base frequency.

The invention is based on the understanding that percussion frequency spread, wherein the frequency variation of the down-the-hole hammer is represented, is a valuable description of the drilling process. At the region of the base frequency, to start with, a wide spread means that the down-the-hole hammer works with widely varying frequencies, whereas is in a narrow spread, the down-the-hole hammer works with like, virtually the same or almost the same frequency over a chosen period. With this knowledge, it is possible to establish whether a drilling parameter adjustment results in a widening or narrowing of the frequency spread. It should also be noted that drilling parameter adjustments often lead to shift of the (base) working frequency and the whole frequency band. This means that adjustments results in that the frequency band as a whole moves to higher or lower frequencies, possibly in addition to widening or narrowing.

A down-the-hole hammer is supplied with percussion and flushing fluid flow and the down-the-hole hammer is subjected to rotational force and to feed force and is basically constructed for drilling at determined frequencies that are depending on hammer fluid pressure, hole length, depth, rock hardness etc. During the drilling process, however, it occurs that occasionally, the drill bit will be slightly advanced in the down-the-hole hammer as a result of softer rock, crevasses in rock etc. On the other hand, at occasions it happens that the drill bit will not be advanced as far as usual during a hammer strike or hammer strikes because of the down-the-hole hammer entering into harder rock.

In the case where the drill bit has advanced slightly beyond a normal position after a strike, this will result in reduction of frequency because the time between hammer strikes will be extended. On the other hand, when the drill bit has not advanced as far as usual, the time between hammer strikes is reduced and the frequency will be increased.

Such variation, with reduced and increased frequency, occur more or less continuously during the drilling process, and the spread can be discovered with reasonable precision in a short time period, already after the hammer having performed about 5-10 strikes. Extending the time period somewhat so that a higher number of strikes have been performed normally increases precision.

This frequency variation is presented according to the invention and as a rule, it is desired that the spread is so narrow, i.e. that strikes are performed with as even a frequency as possible. Hereby several advantages are obtained in that risks of damaging the equipment are reduced. In particular, risk of damaging the drill bit and, induced by the drill bit, risk of damaging the hammer is avoided or at least reduced. Risks of ineffective drilling in case of varying frequency and thereby unstable drilling can be avoided or at least reduced. As a whole, the applying the invention results in possibilities of better drilling economy due to possibilities of control in the direction of optimizing of the drilling process.

Hammer frequency should also be tuned to rotation speed, since it is important for the efficiency of the drilling process that the drill bit has been rotated a determined angle between strikes for ensuring that the hard metal cutting elements of the drill bit engage unaffected rock as much as possible. Varying hammer frequency results in strikes being performed too early or too late in this respect.

Basically, it is here aimed at narrowing the percussion frequency spread for achieving what is described above. This can, however, be obtained through the inventive method by sensing or estimating what here is called a control frequency or frequencies, that is/are representative of the percussion frequency such as i.a. harmonics. One reason for this is that in some instances, such frequencies are more easily picked-up and/or signal treated than the percussion frequency of the hammer. When, in this description, reference is made to "percussion frequency" for signal pick-up and treatment, also such control frequencies can be used. These control frequencies can be directly sensed or estimated or calculated through per se common signal treatment methods. According to the invention, said frequencies are sensed, but in certain instances they are calculated or estimated based from vibrations picked up from the rig, the ground or the air, also through per se common signal treatment methods.

In particular, said at least one drilling parameter is adjusted in a direction where the width of said spread is narrowed. Hereby the drilling is stabilized, resulting in the above indicated advantages in respect of reduced risks of damage to the equipment, more stable drilling and better drilling economy.

With the term " . . . drilling parameter is adjusted in a direction . . . " means that the parameter is adjusted such that the parameter value is increased or reduced, for example that a flow rate value, a pressure value etc. is increased or reduced. "A direction" thus can mean direction of increase or direction of reduction.

Said at least one drilling parameter is normally one or more from the group: feed force/weight on bit, feed rate, rotational speed, rotational torque, percussion fluid flow pressure, percussion fluid flow rate, flushing fluid flow pressure, flushing fluid flow rate. These parameters are easily adjusted manually.

In a preferred embodiment, the percussion frequency of the down-the-hole hammer (or more broadly, control frequency) is sampled to form a representation covering a determined time period. This gives the possibility of signalling a representation that is extra easily understood for an operator. This can be achieved by displaying or otherwise alerting the operator about the conditions of the operation.

Preferably, when it is established that an adjustment in one direction of said at least one drilling parameter results in broadening the width of the spread, the adjustment in that direction is terminated and/or said at least one drilling parameter is readjusted in the opposite direction. Also preferably, when it is established that an adjustment in one direction of said at least one drilling parameter results in narrowing the width of the spread, the adjustment in that direction is maintained or continued in the same direction.

It is preferred that the percussion frequency (or more broadly, control frequency) is detected outside a hole being drilled, at any position from the group: on or adjacent to a drilling rig being associated with the down-the-hole hammer, on the drill string, on the ground, in the adjacent to the drill string, in the air adjacent to the drill string.

In an embodiment that is easy to use, said representation of the spread of the frequency is signalled or displayed for assisting manual adjustment of said at least one drilling parameter.

When the method includes creating a representation of an amplitude of said distribution of said control frequency or frequencies so as to produce a response to an adjustment of at least one drilling parameter as a change of magnitude of said amplitude further advantages are obtained. In a proper representation, high amplitude is an indicator for more efficient drilling. It is therefore beneficial to have the possibility to adjust said at least one drilling parameter in a direction where the magnitude of said amplitude is increased. The drilling parameters that come into question in this respect are the same that have been discussed above in respect of control of spread of distribution of frequency or frequencies.

The invention makes it possible to make combined use of said frequency and amplitude representations for monitoring during drilling. It should be noted that it also provides for the order of consulting frequency representation data and amplitude representation data being optional to the extent that the operator is not bound to consulting any one of these representations before the other.

Further it is preferred that when it is established that an adjustment in one direction of said at least one drilling parameter results in decrease of the magnitude of said amplitude, terminating the adjustment in that direction or readjusting said at least one drilling parameter in the opposite direction.

It is also preferred that when it is established that an adjustment in one direction of said at least one drilling parameter results in increasing the magnitude of said amplitude, maintaining the adjustment in that direction or continuing adjustment in the same direction.

Said representation of said amplitude is advantageously signalled or displayed for assisting manual adjustment of said at least one drilling parameter.

It should be noted that a representation of said amplitude also can be used passively for indicating changes in rock resistance or hardness during drilling. For example, in stable drilling, frequency can be stable even though the drill bit passes rock of different. It is also referred to the above about the advantageous active use of a representation of said amplitude by assisting the operator to take measures so as to control drilling.

In one embodiment of the inventive method, obtained percussion frequency and/or amplitude data are logged and stored in a manner that they are later readable as drilling characteristic. This gives a number of advantages.

Firstly it makes it possible to have pre-knowledge when subsequent holes are to be drilled in a more or less narrow location where drilling of one hole has already been performed and the corresponding data have been logged by logging means and been stored in a memory. Hereby the driller is given indications of what is to be expected during the drilling whereby he is assisted in how to take measures when the drill bit meets different rock formations etc.

Secondly, performance in respect of rig, drill bit, operator etc. can be evaluated.

Corresponding advantages are obtained in respect of a device for monitoring down-the-hole percussion drilling with a down-the-hole hammer. This device includes one or more sensor units for detecting or estimating a control frequency or frequencies being representative of the percussion frequency of the down-the-hole hammer. The device also includes a representation means for creating a representation of a spread of said control frequency or frequencies and for producing a response to an adjustment of at least one drilling parameter as a change of width of said spread. The representation means can i.a. be a visual display or an audio signalling device for assisting in manual parameter control.

The down-the-hole hammer is supplied with percussion and flushing fluid flow and the down-the-hole hammer is subjected to rotational force and to feed force.

It is also within the scope of the invention that the representation output simply is a number, which is indicative of the width of the spread. The aim is then to reduce that number, whereby the frequency spread is narrowed.

The representation means can i.a. also be circuitry for creating a virtual frequency spread width value. That circuitry can either be associated with a visual display or an audio signalling device as above.

BRIEF DESCRIPTION OF THE DRAWINGS

The invention will now be described by way of embodiments and with reference to the annexed drawings, wherein.

DETAILED DESCRIPTION OF EMBODIMENTS OF THE INVENTION

Figure 1:
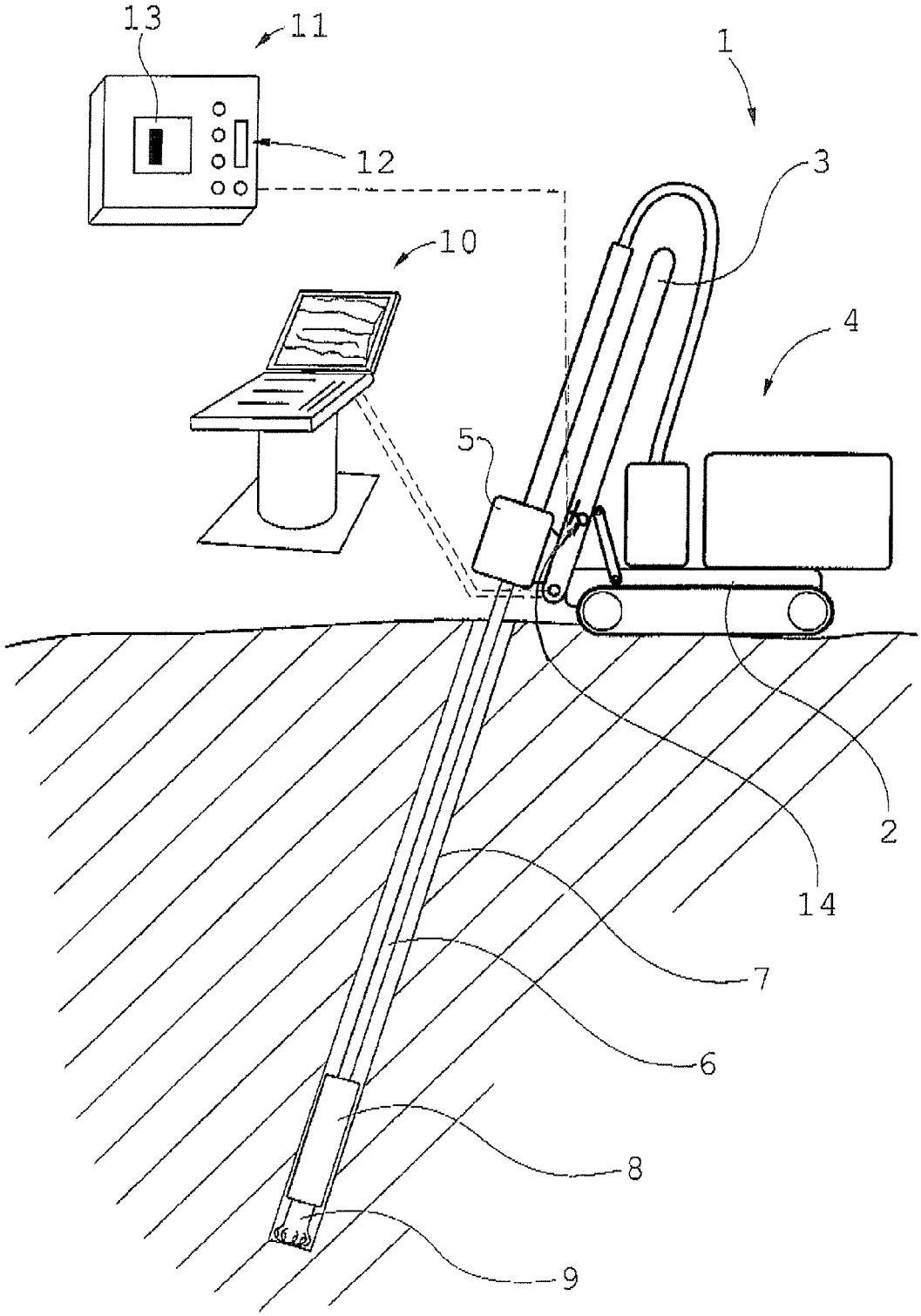
FIG. 1 shows a system including a device for monitoring down-the-hole percussion drilling according to the invention in a diagrammatical overview.

FIG. 1 shows a drilling rig for down-the-hole percussion drilling which includes a substructure 2 such as a support frame for supporting the drilling rig against a substrate. The substructure 2 supports equipment for supply of a down-the-hole hammer 8, said equipment including, inside a cover 4, (not shown) a motor and various pumps for the supply of hammer pressure fluid, rotator fluid, feed fluid etc. Said equipment is connected to a drill string 6 over per se known means.

The substructure 2 supports a feed beam 3 which can be angled as desired over a pivot joint in a conventional manner. The feed beam 3 supports a to-and-fro slidingly moveable rotator 5 for providing rotation to the drill string 6 during the drilling process. The drill string 6 is, in a conventional manner, comprised of a number of pipe sections which are threaded to one another. Inside the pipes there are channels for the transport of hammer pressure fluid and flushing fluid.

At the free end of the drill string 6, inside the drilled hole 7, there is provided the down-the-hole hammer 8 which includes a hammer piston that is driven by the hammer pressure fluid supplied by the said equipment through the drill string 6 to the hammer 8 in a per se known manner.

At the front end of the hammer 8 there is received a drill bit 9 having a front face with distributed hard metal cutting elements for the engagement with rock during the drilling process. 10 indicates a control unit with a display for allowing an operator to set parameter values concerning various fluid pressures etc. in order to control the operation of the drilling rig 1. 11 indicates a device for monitoring the drilling process having setting buttons 12 and a display 13.

The device 11 for monitoring down-the-hole percussion drilling is associated with a monitoring means, which in this case includes a sensor 14 capable of measuring frequency, which in turn in this embodiment is placed on the feed beam 3 of the drilling rig 1. As sensors 14, different sensors can come into question, such as sensors measuring acceleration, sensors measuring velocity or sensors measuring physical displacement. The sensor 14 is capable of picking up vibrations that the feed beam 3 is subjected to, where among are vibrations emanating from strikes performed by the down-the-hole hammer 8. In one embodiment, the sensor 14 is positioned on a rotary head in the form of the rotator 5.

The device 11 further includes circuitry for filtering out vibrations of interest, which in this case are the vibrations that emanate from the down-the-hole hammer 8 during the drilling process. Other various vibrations such as emanating from the rotator, from the feed mechanism etc of the drilling rig 1 and possibly from external sources are not of interest in respect of the present invention and are therefore normally cancelled out/filtered away in circuitry inside the device for monitoring 11.

This way it is possible to create a representation of the percussion frequency of the down-the-hole hammer 8 and in particular of a spread of the percussion frequency, which means that varying frequencies beside a percussion frequency of the down-the-hole hammer can be represented in such a way that a width of spread of frequency in the area of the base frequency can be displayed or signalled. The device 11 for monitoring is separate from the control system of the drilling rig 1 in FIG. 1. This is true even though the frequency sensor 14 is attached to a part of the very drilling rig 1.

Figure 2:
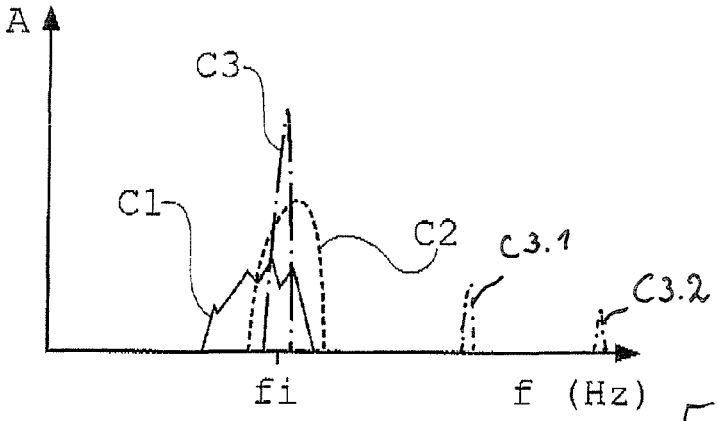
FIG. 2 shows a diagram over three different percussion frequency distribution representations for illustrating percussion frequency spread under three different operational conditions.

In FIG. 2, the three different frequency distribution representations are illustrations of frequency spread in three different operational conditions of a down-the-hole hammer. Here is illustrated in a diagram the occurrence A of strikes performed by the hammer as a function of percussion frequency f over a chosen time period. It is thus shown that for different operational conditions, the hammer performs strikes with more or less even frequency around an ideal frequency $f_i$.

The full line curve C1 relates to operation with a considerable frequency spread leading to inferior drilling operation.

The interrupted line curve C2 relates to operation with less spread and with a distinct peak leading to more acceptable drilling. This style of operation is what can be expected to be achieved, at least from time to time, by a highly experienced and skilful operator.

The dot-interrupted line C3 relates to operation that is nearly ideal drilling. Here, the strikes are to a very high degree performed at or very close to the ideal frequency. This style of operation can be achieved according to the present invention during an entire drilling process.

FIG. 2 also shows first C3.1 and second C3.2 "overtones" (corresponding to second and third harmonics) for the operation corresponding to C3. According to the invention, it is not excluded that monitoring is based on such overtone representations, that basically provide spread corresponding to what is described herein in respect of spread in the region of the base frequency.

In FIGS. 3-7 there is shown an example of a user interface layout wherein there are a number of operator entries such as hammer, pressure and the number of pipes that at the moment are included in the drill string. In the display 15 is further shown (at the right side in the display in FIG. 3) "Freq" or frequency, where the black square is actual frequency and the arrow indicates ideal frequency. "Spread" where the black square indicates amount of variation of frequency for the actual frequency.

Figure 3:
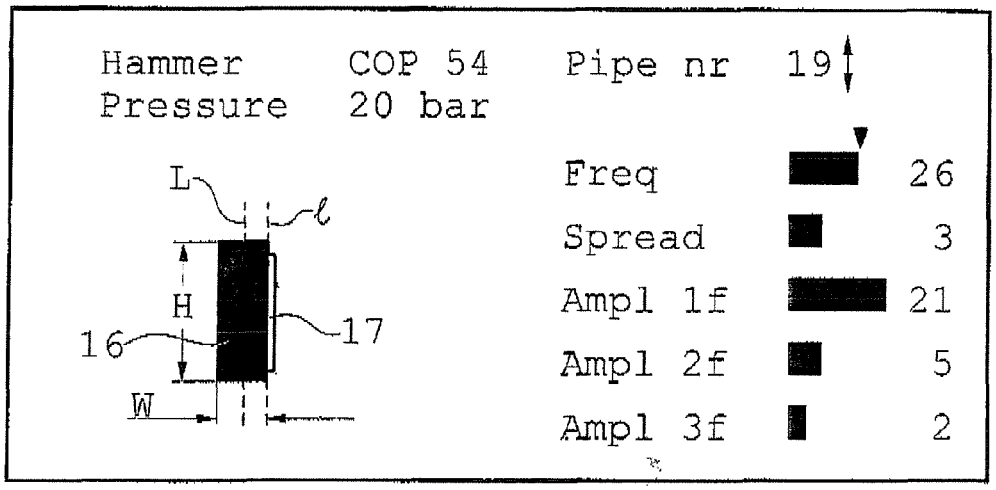
FIGS. 3-7 show an embodiment of a user interface layout for a display of a device according to the invention in different situations.

In particular, in the display in FIG. 3, "Hammer" is type of hammer used; "Pressure" is percussion fluid flow pressure (in bar); "Pipe nr" is number of pipes (drill string elements) in the drill string; "Freq" is base (average) percussion frequency of the hammer; "Spread" is width of the present percussion frequency distribution.

"Ampl 1f" being the amplitude of the first frequency which is the base frequency whereas "Ampl 2f" and "Ampl 3f" indicate amplitudes of first and second harmonics of the picked-up frequency.

All frequencies can be in Hz or simply be a display value used for reference.

At the left side in the display in FIG. 3, there is shown a black square 16 indicating the width (W) of the frequency spread of the actual frequencies picked-up by a sensor and having a height (H), which in this case represents the sum of amplitudes of Ampl 1f, 2f and 3f related to the very mathematical method used. In this case the method is by sampling over time of picked-up frequencies as seen over a determined time period. The black square 16 is to be regarded as a transformation of something that can be said to be the percussion frequency distribution (represented by the actual one of the curves C1-C3 in FIG. 2) and is one example of a user interface that is easily understood by an operator so as to assist him to make proper parameter adjustments.

Faced with the display in FIG. 3 the task of the operator is to narrow the width W in order to reach a width V as seen in a target square 17 (see FIG. 4), so as to obtain a more ideal and more stable drilling. As is the case in FIG. 2, the drilling tends to be unstable resulting in the disadvantage that is mentioned above in the introductory portion of this description.

Further, the frequency spread represented by the black square 16 in FIG. 3 is with its central part, indicated by centre line L, obviously to the left of a central part of the target square 17 indicated by centre line 1. This means that the actual frequency also is slightly below the ideal frequency related to the chosen hammer, the set pressure and prevailing values of the parameters affecting the drilling process. For this reason the operator shall aim to increase the frequency slightly such that a central line L of the black square 16 coincides with a central line 1 of the target square 17.

Figure 4:
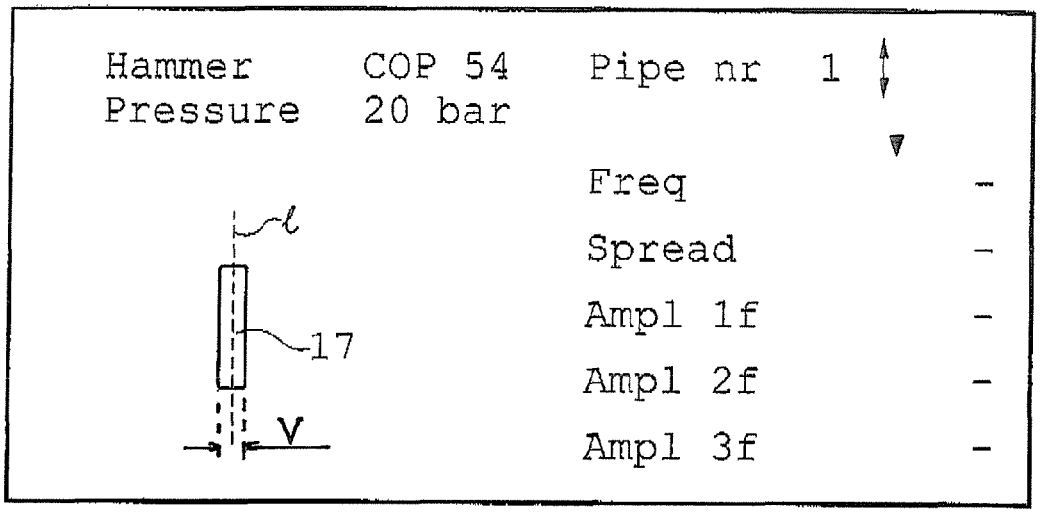

In FIG. 4, is shown the initial display before having started the drilling process, wherein the white square 17 as the target is shown without being covered by the black square as in FIG. 3. As can be seen to the right in this figure, no drilling values are represented.

Figure 5:
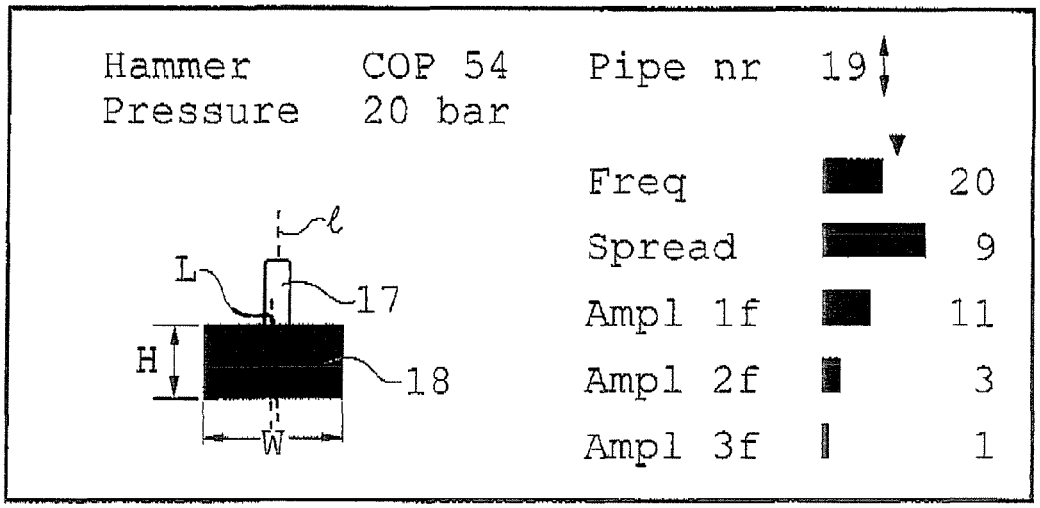

In FIG. 5, there is shown a second drilling situation, where the black square 18 is even wider (W) than is the case in FIG. 3 and thus the frequency spread is wider. It can also be seen that the height H of the black square 18 is relatively low indicating that in this embodiment hammer efficiency is relatively low and that hammer force is wasted by out of tune hammering.

The aim of the operator should thus be to adjust parameter settings of the drill rig so as to reduce W, to narrow the black square 18 and thereby the frequency spread and to slightly adjust a centre line of the frequency distribution representation so as to coincide with a centre line of the target square 17.

As an example, in general, the frequency spread can be obtained by sampling of the actually performed, varying percussion frequency of the hammer over a determined time period. This time period is held so short that virtually real-time monitoring is obtained and long enough for a sufficient number of strikes to be performed in order that a representative spread is obtained.

Figure 6:
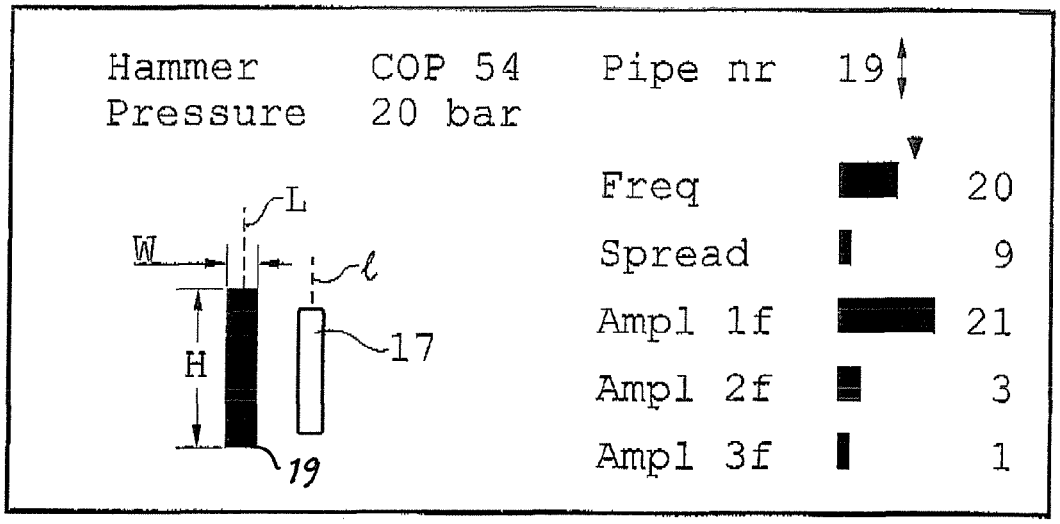

FIG. 6 shows a situation where the frequency can be said to be stable because the black square 19 is of acceptable widths indicating that the frequency spread is low whereas a centre line of the black square 19 is to the left of the centre of the target square 17 indicating that the hammer is drilling below ideal frequency. The aim of the operator is in this case thus simply to increase hammer frequency.

Figure 7:
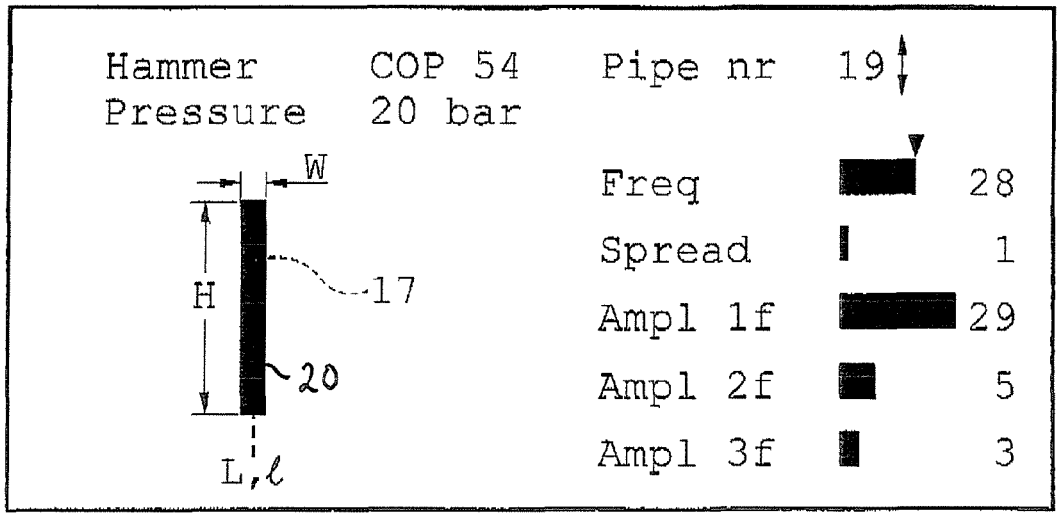

This has been achieved in the display as shown in FIG. 7, where the black square 20 completely covers the target square 17 and has the same width as the target 17. The hammer is here working at the ideal frequency and the amplitude has risen so as to be relatively high.

It could be mentioned that in general, too high amplitude can be detrimental for the drilling process in that it might damage the drill bit.

Figure 8:
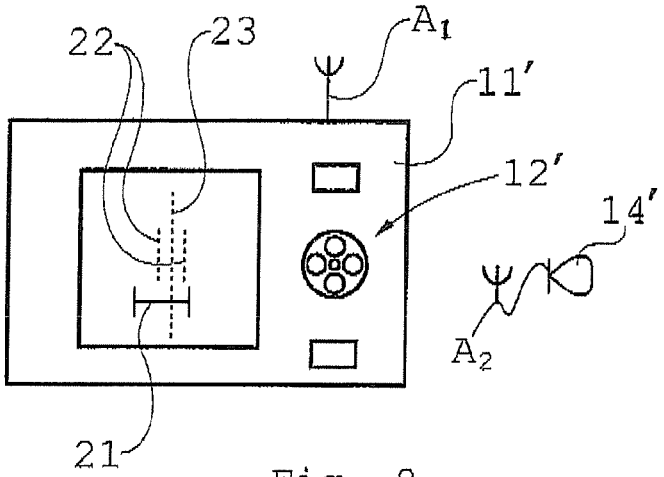
FIG. 8 shows a second embodiment of another user interface layout for a display of a device according to the invention.

FIG. 8 shows a simple variant of a device 11' with a display for monitoring percussion drilling, wherein 21 represents an actual frequency distribution as picked-up by a frequency sensor 14' positioned in the area of a (not shown) drilling rig. The device 11' communicates with the frequency sensor 14' over a wireless system via antennas A1 and A2. 12' indicates setting buttons corresponding to what is shown in FIG. 3. The width of spread of the frequency distribution 21 represents the frequencies preformed by the down-the-hole hammer (not shown). 22 indicates with interrupted lines two target limits for the width of the frequency spread and 23 indicates with an interrupted line a centre line representing an ideal frequency at the prevailing conditions for the used hammer, pressures etc.

The operator using the device 11' in FIG. 8 has the task of adjusting drilling rig parameters so as on the one hand to narrow the frequency spread, on the other hand to slightly increase a central or average frequency so as to coincide with the interrupted line 3.

It could be mentioned that in practice this can be achieved by the operator starting to adjust one parameter, such as amend feed force/weight on bit and/or rotations feed. By making adjustments to that one parameter, the operator immediately gets feedback from the device 11' if the representation shows a widening or a narrowing of the spread. If the spread is widening as the result of the adjustment, the operator terminates adjustments in that direction and instead tries to adjust in the opposite direction whereupon he gets immediate feedback if this path is successful. Thereupon, if the width of spread is still wider than the target, the operator goes on to adjust another parameter, such as for example rotations speed and gets feedback in the corresponding way so as to reach target width and also target frequency (ideal frequency).

Figure 9A:
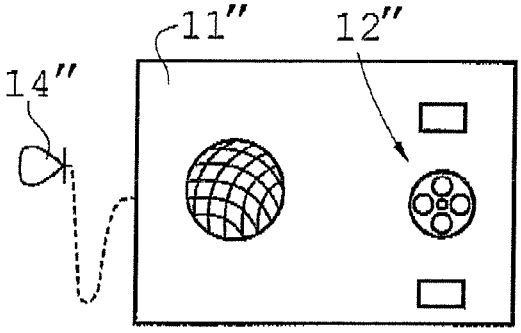
FIG. 9*a* shows a third embodiment of a user interface for creating audio signals.

FIG. 9*a* shows an alternative embodiment, wherein a device 11" is an audio signalling device adapted to emit audio signals through a loud speaker 24 as representations of the frequency spread. 14" indicates a frequency sensor which can be of the same type of different type as is discussed above.

Figure 9B:
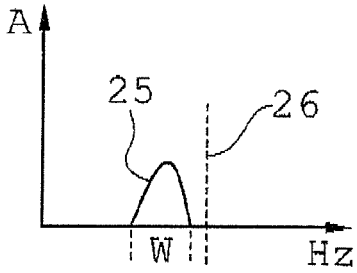
FIG. 9*b* shows a graph illustrating audio signals created by the user interface in FIG. 9*a*.

FIG. 9*b* illustrates in a graph an emitted sound signal 25 which in this case is relatively wide with a width W resulting in a relatively fuzzy sound signal which also has its peak sidewise, below, an ideal target frequency indicated with an interrupted line at 26. In practice the ideal frequency could be signalled as indeed interrupted sound signals having an easily perceivable frequency (obviously much higher than the percussion frequency) as created inside the device 11".

The aim of the operator is thus here to make adjustment so that the fuzzy signal 25 becomes clearer with narrow frequency distribution and thereby the curve 25 narrower and to have the peak frequency coinciding with the target frequency 26. As an alternative, as a complement or a replacement to said audio signal, a visual display showing basically the graph in FIG. 9*b* can be presented to the operator.

Figure 10:
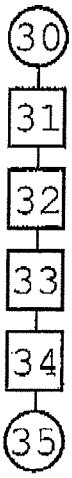
FIG. 10 shows a block diagram illustrating an embodiment of the inventive method.

FIG. 10 shows a block diagram illustrating an embodiment of the inventive method, whereby:

Position 30 indicates the start of the session.

Position 31 indicates obtaining frequency signals from a frequency sensor.

Position 32 indicates treating signals received from the frequency sensor so as to isolate relevant signals relating to hammer strikes, to cancel out possible noise signals relating to other sources and to pass on isolated relevant signals.

Position 33 indicates receiving isolated relevant signals and to transform these signals into a format that is suitable for creating a perceivable representation.

Position 34 indicates signalling or displaying a representation of frequency spread.

Position 35 indicates the end of the session.

Positions 31-35 are continuously or intermittently repeated within chosen, preferably short time periods so as to accurately reflect present actual operation of the monitored drilling rig.

The session can advantageously be complemented with the steps of setting values for fixed parameters such as i.e. hammer type, pipe number etc.

Figure 11:
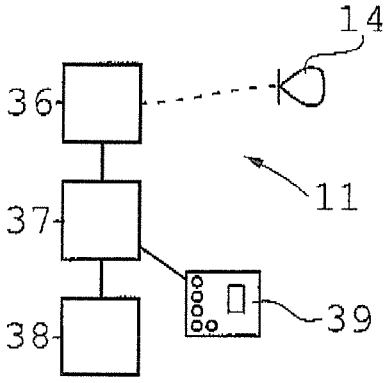
FIG. 11 shows diagrammatically a monitoring device according to the invention by way of function blocks.

FIG. 11 shows diagrammatically an embodiment of a monitoring device according to the invention, which is comprised of:

A frequency sensor 14 of a sensor unit for obtaining frequency signals emanating from a down-the-hole hammer.

A signal treating device 36 receiving signals from the frequency sensor and capable of isolating relevant signals relating to hammer strikes, to cancel out possible noise signals relating to other sources and to pass on isolated relevant signals.

A calculating unit 37 receives isolated relevant signals from the device 36 and transforms these signals into a format that is suitable for creating a perceivable representation.

A display device 38 having a screen for display of the representation of a frequency spread.

A key-board 39 for operator entry of certain values.

The signal treating device 36 can be a sensor circuit and be integrated in the frequency sensor or in the calculating unit 37. The display device is suitably integrated together with the key-board 39 in a housing enclosing a calculation circuit of the calculating unit 37.

The frequency sensor 14 and the signal treating device 36 can be said to make up a sensor unit for sensing and estimating the percussion frequency of the down-the-hole hammer (or more broadly, control frequency).

The calculating unit 37 and the display device 38 can be said to make up a representation means for creating a representation of a spread of the percussion frequency and for producing a response to an adjustment of at least one drilling parameter as a change of width of said spread.

Figure 12:
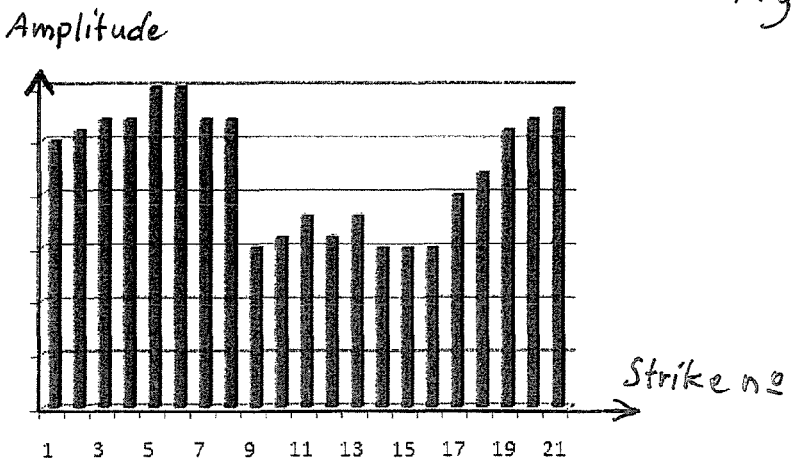
FIG. 12 shows in a bar chart a representation of strike amplitude for a number of consecutive strikes.

FIG. 12 shows in a bar chart a representation of strike amplitude for a number of consecutive strikes performed by a down-the-hole hammer. Variation in amplitude is an indicator of changes in the properties of the rock met by the drill bit. According to this Fig. there is an abrupt decrease in amplitude between strike 8 and 9 indicating that the drill bit has come into a rock formation making altered resistance to the drill bit, most often because of change in hardness. Strikes 15-21 are performed with continuously increasing amplitude indicating that the drill bit is meeting rock with continuously altering properties in respect of resistance. The information in FIG. 12 can be useful for the operator in determining the progress of the drilling process, but preferably the amplitude data are sampled over a determined time period and presented in a format that is more quickly perceivable to the operator. Such a presentation can be in the form of the filled bars in the left region of FIGS. 3-7, wherein "H" can be a representation of such amplitude sampling. The variation in representation of amplitude can advantageously i.a. be used to guide in the direction of higher drilling rate. In stable drilling with even frequency and more or less constant and acceptable frequency spread, amplitude could still vary with rock properties.

The invention can be modified within the scope of the annexed claims. Other types of devices or means for signalling can be contemplated and the representation of the frequency spread can be laid out otherwise, for example as non-linear, such as round or oval figures that the operator can use as areas to be minimized through adjustments of parameters.

It is also possible to provide a display with trend arrows that indicate on the one hand frequency spread trends and possibly also amplitude variation trends so as to assist the operator in controlling the drilling process.

The monitoring means and the representation means can also be different in respect of interfaces between circuitry carrying out these functions. For example they can have integrated parts, hardware and/or software.

It is also possible to use a display showing essentially the curve format in FIG. 2.

The invention has so far been related to control based on signals and values that have been obtained and calculated during the drilling process. The invention, however, makes it possible to provide different follow-up options in that data obtained through the inventive method and device can be logged, stored and arranged for subsequent use. Thereby, short term as well as long term results and trends can be determined in respect of individual operators and drilling rigs. This can be used in general for efficiency control. One particular use of such results and trends is that it can provide a tool for the rig owner to find out e.g. where more extensive training of operators could be required.

The invention claimed is:

1. A method for monitoring down-the-hole percussion drilling, the drilling being performed with a down-the-hole hammer, the method comprising:

detecting or estimating a control frequency or frequencies being representative of a percussion frequency of strikes per unit time of the down-the-hole hammer, and creating a representation of spread of distribution of said control frequency or frequencies so as to produce a response to an adjustment of at least one drilling parameter as a change of width of said spread.

2. The method according to claim 1, wherein said at least one drilling parameter is adjusted in a direction where the width of said spread is narrowed.

3. The method according to claim 1, wherein said at least one drilling parameter is one or more from the group: feed force/weight on bit, feed rate, rotational speed, rotational torque, percussion fluid flow pressure, flushing fluid flow pressure.

4. The method according to claim 1, wherein said control frequency or frequencies is/are sampled to form a representation covering a desired or determined time period.

5. The method according to claim 1, wherein when it is established that an adjustment in one direction of said at least one drilling parameter results in broadening the width of the percussion frequency spread, the adjustment in the one direction is terminated or said at least one drilling parameter is readjusted in the opposite direction.

6. The method according to claim 1, wherein when it is established that an adjustment in one direction of said at least one drilling parameter results in narrowing the width of the percussion frequency spread, the adjustment in the one direction is maintained in the one or adjustment is continued in the same direction.

7. The method according to claim 1, wherein the control frequency or frequencies is/are detected outside a hole being drilled, at any position from the group: on or adjacent to a drilling rig being associated with a down-the-hole hammer, on a drill string, on the ground adjacent to the drill string, in the air adjacent to the drill string.

8. The method according to claim 1, wherein said representation of the spread of the percussion frequency is signaled or displayed for assisting manual adjustment of said at least one drilling parameter.

9. The method according to claim 1, wherein said control frequency is a base percussion frequency or a second harmonic or further harmonic thereof.

10. The method according to claim 1, further comprising:

creating a representation of an amplitude of said distribution of said control frequency or frequencies so as to produce a response to an adjustment of at least one drilling parameter as a change of magnitude of said amplitude.

11. The method according to claim 10, wherein said at least one drilling parameter is adjusted in a direction where the magnitude of said amplitude is increased.

12. The method according to claim 10, wherein when it is established that an adjustment in one direction of said at least one drilling parameter results in decrease of the magnitude of said amplitude, terminating the adjustment in that direction or readjusting said at least one drilling parameter in the opposite direction.

13. The method according to claim 10, wherein when it is established that an adjustment in one direction of said at least one drilling parameter results in increasing the magnitude of said amplitude, maintaining the adjustment in that direction or continuing adjustment in the same direction.

14. The method according to claim 10, wherein said representation of said amplitude is signaled or displayed for assisting manual adjustment of said at least one drilling parameter.

15. The method according to claim 10, wherein amplitude data are sampled to form a representation covering a desired or determined time period.

16. The method according to claim 1, wherein obtained percussion frequency and/or amplitude data are logged and stored in a manner that they are later readable as drilling characteristic.

17. A device for monitoring down-the-hole percussion drilling, the drilling being performed with a down-the-hole hammer, the device comprising:

a sensor unit for detecting or estimating a control frequency or frequencies being representative of a percussion frequency of strikes per unit time of the down-the-hole hammer, and a representation creating unit configured to create a representation of a spread of distribution of said control frequency or frequencies so as to produce a response to an adjustment of at least one drilling parameter as a change of width of said spread.

18. The device according to claim 17, further comprising:

a circuit arranged to sample the control frequency or frequencies to form a representation covering a determined time period.

19. The device according to claim 17, further comprising:

at least one sensor capable of measuring frequency, the sensor being positioned outside a hole being drilled, at any position from the group: on or adjacent to a drilling rig being associated with the down-the-hole hammer, on the drill string, on the ground adjacent to the drill string, in the air adjacent to the drill string.

20. The device according to claim 17, further comprising:

a signaling or display device arranged for providing output assisting manual adjustment of said at least one drilling parameter based on said representation of the spread of the percussion frequency.

21. The device according to claim 17, further comprising:

a representation creating unit configured to create a representation of an amplitude of said distribution of said control frequency or frequencies so as to produce a response to an adjustment of at least one drilling parameter as a change of magnitude of said amplitude.

22. The device according to claim 17, further comprising:

a logging and storing unit configured to log and store obtained percussion frequency and/or amplitude data in a manner that they are later readable as drilling characteristic.

* * * * *